US008948616B2

(12) United States Patent
Tanaka

(10) Patent No.: US 8,948,616 B2
(45) Date of Patent: Feb. 3, 2015

(54) IMAGE FORMING APPARATUS TO DISCRIMINATE TONER CARTRIDGE

(75) Inventor: Yoshiaki Tanaka, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 526 days.

(21) Appl. No.: 13/267,740

(22) Filed: Oct. 6, 2011

(65) Prior Publication Data

US 2012/0106985 A1 May 3, 2012

Related U.S. Application Data

(60) Provisional application No. 61/409,948, filed on Nov. 3, 2010.

(51) Int. Cl.
*G03G 15/08* (2006.01)

(52) U.S. Cl.
CPC ..... *G03G 15/0886* (2013.01); *G03G 15/0863* (2013.01); *G03G 2215/069* (2013.01); *G03G 2215/0695* (2013.01)
USPC ..... 399/12; 399/13

(58) Field of Classification Search
None
See application file for complete search history.

(56) References Cited

U.S. PATENT DOCUMENTS

| | | | | |
|---|---|---|---|---|
| 6,266,506 | B1 * | 7/2001 | Kurz et al. | 399/262 |
| 6,292,644 | B1 | 9/2001 | Goto et al. | |
| 2007/0177886 | A1 | 8/2007 | Taguchi et al. | |

FOREIGN PATENT DOCUMENTS

| | | | | |
|---|---|---|---|---|
| JP | 03-267965 | | 11/1991 | |
| JP | 2000-162861 | | 6/2000 | |
| JP | 2007-178969 | | 7/2007 | |
| JP | 2007-178969 | A * | 7/2007 | G03G 15/08 |
| JP | 2011-191618 | | 9/2011 | |

OTHER PUBLICATIONS

Office Action dated Dec. 24, 2013, filed in corresponding Japanese Patent Application No. 2011-228028, with English translation.
Office Action dated Apr. 21, 2014, filed in corresponding Chinese Patent Application No. 20111341556.3, with English translation.

* cited by examiner

*Primary Examiner* — Clayton E Laballe
*Assistant Examiner* — Jas Sanghera
(74) *Attorney, Agent, or Firm* — Patterson & Sheridan LLP.

(57) ABSTRACT

According to one embodiment, a toner cartridge includes a toner container to be attached to and detached from an image forming apparatus body, a shutter to open and close a toner supply port of the toner container, and a key that indicates a type of the toner cartridge and allows the shutter to slide if the key coincides with a release part of the image forming apparatus body.

15 Claims, 6 Drawing Sheets

IMAGE FORMING APPARATUS TO DISCRIMINATE TONER CARTRIDGE

CROSS REFERENCE TO RELATED APPLICATION

This application is based upon and claims the benefit of priority from Provisional U.S. Application 61/409,948 filed on Nov. 3, 2010, the entire contents of which are incorporated herein by reference.

FIELD

Embodiments described herein relate generally to an image forming apparatus, such as a copying machine or a printer, in which a toner cartridge to supply toner to a developing device is attached to and detached from an apparatus body.

BACKGROUND

In a developing device of an electrophotographic image forming apparatus such as a copying machine or a printer, there is a device to supply toner to the developing device by an attachable and detachable toner cartridge. The model number of the toner cartridge varies according to, for example, the destination or the color of the toner. In order to prevent a toner cartridge having an improper model number from being used for an image forming apparatus, there is a device in which nested concave and convex parts to discriminate the model number are provided on a body of the image forming apparatus and the outer periphery of a toner container of the toner cartridge. If the toner cartridge has the proper model number, the concave and convex parts of the body of the image forming apparatus and the outer periphery of the toner container are fitted to each other, and the toner cartridge is mounted in the image forming apparatus.

However, in order to provide the concave and convex parts for discriminating the model number on the outer periphery of the toner container, a mold for forming the toner container must be prepared for each model number, and there is a fear that cost reduction is prevented.

DETAILED DESCRIPTION

In general, according to one embodiment, a toner cartridge includes a toner container to be attached to and detached from an image forming apparatus body, a shutter to open and close a toner supply port of the toner container, and a key that indicates a type of the toner cartridge and allows the shutter to slide if the key coincides with a release part of the image forming apparatus body.

Hereinafter, embodiments will be described.

First Embodiment

Figure 1:
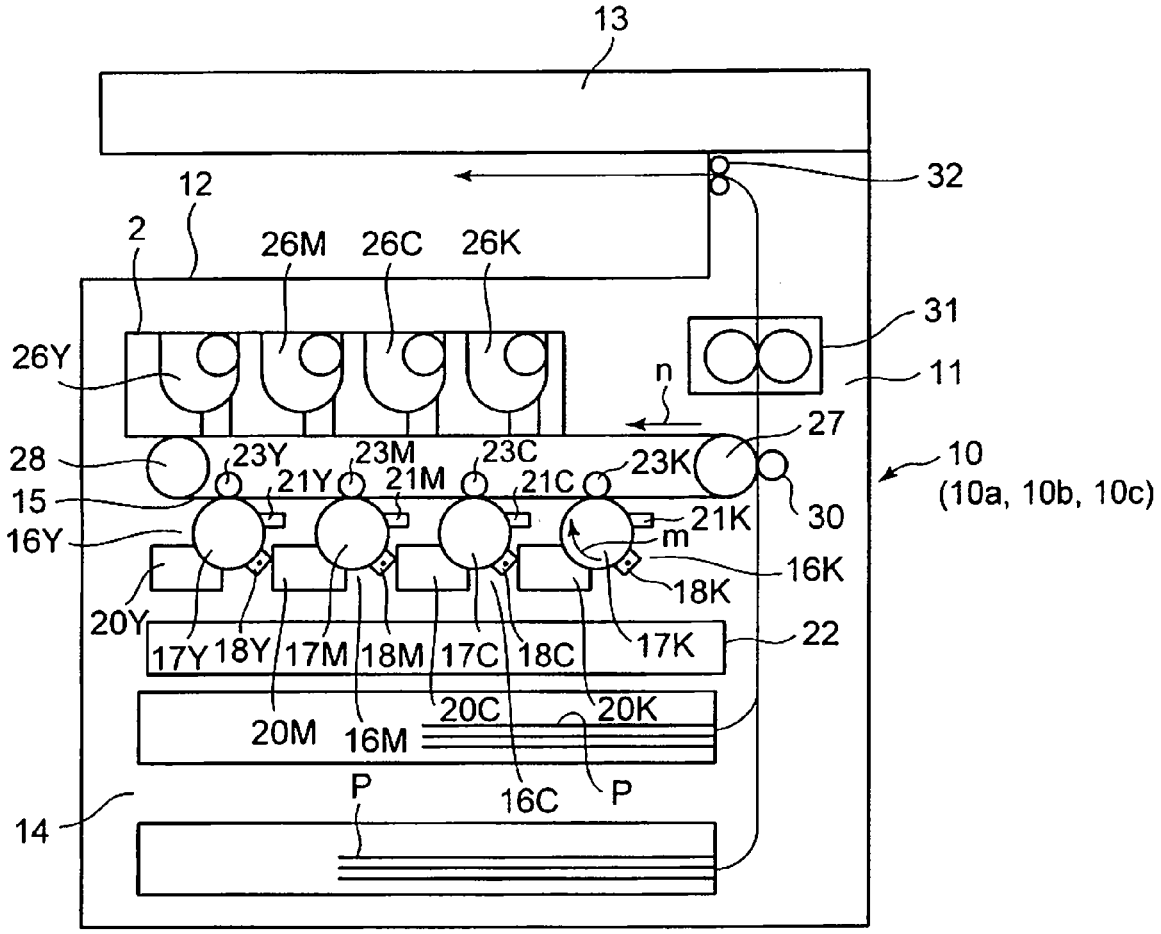
FIG. 1 is a schematic structural view showing an MFP of a first embodiment.

FIG. 1 shows a color MFP (Multi Functional Peripheral) 10 as an image forming apparatus of a first embodiment. The MFP 10 is classified into, for example, an MFP 10*a* whose destination is Japan, an MFP 10*b* whose destination is Southeast Asia, and an MFP 10*c* whose destination is North America. In the MFP 10, the arrangement of an after-mentioned pusher 7 varies according to the destination. The MFP 10 includes, for example, a printer part 11 to form an image, a paper discharge part 12 to contain a sheet P discharged from the printer part 11, a scanner part 13 to read an image, and a paper feed part 14 to feed the sheet P.

The printer part 11 includes four sets of image forming stations 16Y, 16M, 16C and 16K of Y (yellow), M (magenta), C (cyan) and K (black), which are arranged in parallel along the lower part of an intermediate transfer belt 15. The image forming stations 16Y, 16M, 16C and 16K respectively include photoconductive drums 17Y, 17M, 17C and 17K as image carriers.

The respective image forming stations 16Y, 16M, 16C and 16K include chargers 18Y, 18M, 18C and 18K, developing devices 20Y, 20M, 20C and 20K, and photoreceptor cleaners 21Y, 21M, 21C and 21K around the photoconductive drums 17Y, 17M, 17C and 17K rotating in an arrow m direction.

Primary transfer rollers 23Y, 23M, 23C and 23K are arranged at positions opposite to the photoconductive drums 17Y, 17M, 17C and 17K across the intermediate transfer belt 15. The respective primary transfer rollers 23Y, 23M, 23C and 23K primarily transfer toner images formed on the respective photoconductive drums 17Y, 17M, 17C and 17K to the intermediate transfer belt 15. The respective photoreceptor cleaners 21Y, 21M, 21C and 21K remove and collect remaining toners on the respective photoconductive drums 17Y, 17M, 17C and 17K after the primary transfer.

A laser exposure device 22 irradiate exposure lights corresponding to the respective colors to the photoconductive drums 17Y, 17M, 17C and 17K between the chargers 18Y, 18M, 18C and 18K and the developing devices 20Y, 20M, 20C and 20K. Electrostatic latent images are formed on the photoconductive drums 17Y, 17M, 17C and 17K by the irradiation of the exposure lights from the laser exposure device 22.

The respective developing devices 20Y, 20M, 20C and 20K use two-component developers including toners and carriers, and supply the toners to the electrostatic latent images on the photoconductive drums 17Y, 17M, 17C and 17K to visualize the electrostatic latent images. The respective developing devices 20Y, 20M, 20C and 20K use the two-component developers including toners of Y (yellow), M (magenta), C (cyan) and K (black) and carriers, and perform development.

A housing 1 of the MFP 10 as an image forming apparatus body includes a cartridge holder 2 which is located above the developing devices 20Y, 20M, 20C and 20K and to and from which toner cartridges 26Y, 26M, 26C and 26K are attached and detached. The respective toner cartridges 26Y, 26M, 26C and 26K mounted in the cartridge holder 2 contain toners of Y (yellow), M (magenta), C (cyan) and K (black). If the toner densities of the respective developing devices 20Y, 20M, 20C and 20K are reduced, the respective toner cartridges 26Y, 26M, 26C and 26K supplies necessary amounts of toners to the respective developing devices 20Y, 20M, 20C and 20K.

The intermediate transfer belt 15 is stretched between a buck-up roller 27 and a driven roller 28, and rotates in an arrow n direction. A secondary transfer roller 30 faces a secondary transfer position of the intermediate transfer belt 15 supported by the back-up roller 27. A specified secondary bias is applied between the back-up roller 27 and the secondary transfer roller 30. The toner images on the intermediate transfer belt 15 are collectively secondarily transferred onto the sheet P passing through between the intermediate transfer belt 15 and the secondary transfer roller 30.

The printer part 11 includes a fixing device 31 and a paper discharge roller 32 at the downstream side of the secondary transfer roller 30. The fixing device 31 fixes the toner image transferred on the sheet P in the secondary transfer part to the sheet P. The paper discharge roller 32 discharges the sheet P having the fixed toner image to the paper discharge part 12.

Figure 4:
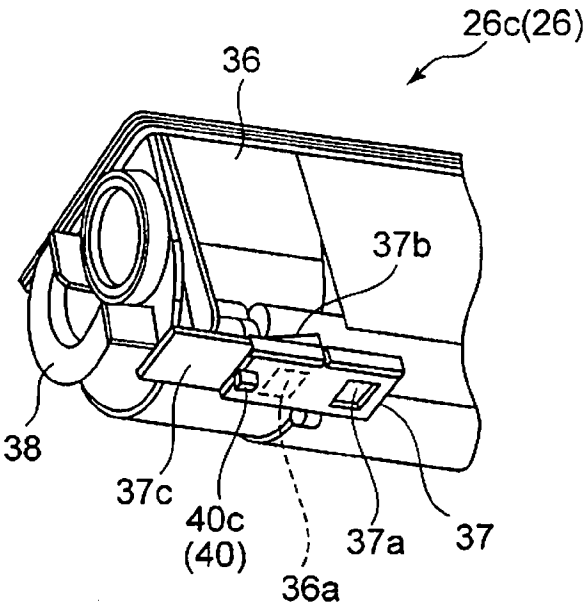
FIG. 4 is a partial perspective view in which a toner cartridge for North America in the first embodiment is seen from below.
Figure 3:
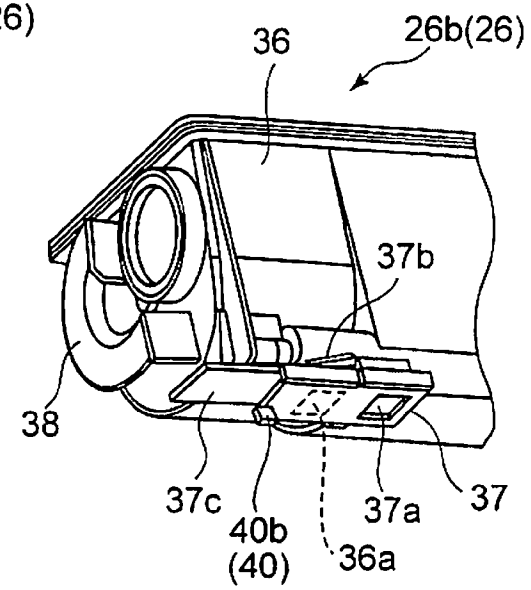
FIG. 3 is a partial perspective view in which a toner cartridge for Southeast Asia in the first embodiment is seen from below.

The toner cartridges 26Y, 26M, 26C and 26K will be described in detail with reference to FIG. 2 to FIG. 4. Although the toner cartridges 26Y, 26M, 26C and 26K contain different toners, the toner cartridges 26Y, 26M, 26C and 26K have the same structure except a key of a shutter. Incidentally, the toner cartridge 26K has a larger toner containing volume than the other toner cartridges 26Y, 26M and 26C. The structure, mainly the shutter, of the toner cartridges 26Y, 26M, 26C and 26K will be described by use of common reference numerals.

Figure 2:
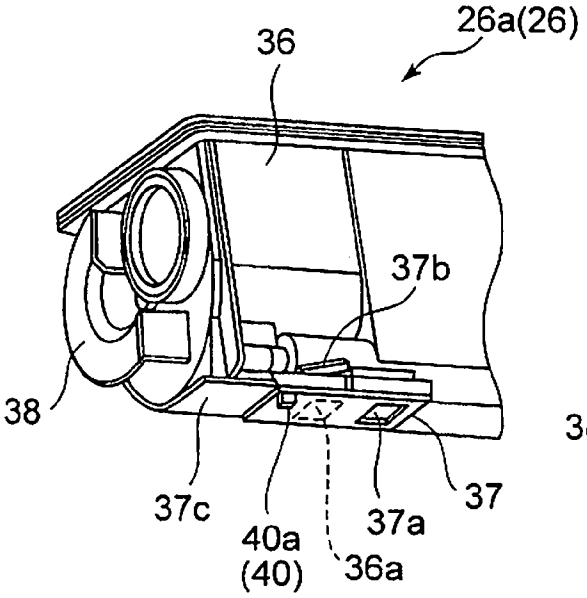
FIG. 2 is a partial perspective view in which a toner cartridge for Japan in the first embodiment is seen from below.

As shown in FIG. 2, the toner cartridge 26 includes a toner supply port 36*a* at the front side of a toner container 36 for containing toner. The toner cartridge 26 includes a shutter 37 to open and close the toner supply port 36*a*. The shutter 37 slides along a guide 37*c* in a direction parallel to a mounting direction of the toner cartridge 26 according to the toner cartridge 26 is mounted into the cartridge holder 2. The shutter 37 slides a communication port 37*a* of the shutter 37 to the position of the toner supply port 36*a* and the shutter 37 opens the toner supply port 36*a*.

According to the toner cartridge 26 is extracted from the cartridge holder 2, the shutter 37 slides in a direction parallel to an extracting direction of the toner cartridge 26 by a spring 37*b*, and closes the toner supply port 36*a*. The toner cartridge 26 includes a handle 38 by which the toner cartridge 26 is attached to and detached from the cartridge holder 2.

The shutter 37 includes a key 40 to allow the shutter 37 to slide. The key 40 indicates the type of the toner cartridge 26. The key 40 indicates the type of the toner cartridge 26 by changing the arrangement position on the shutter 37. The type of the toner cartridge 26 is, for example, the type according to the destination of the toner cartridge 26. As shown in FIG. 2, for example, if a toner cartridge 26*a* is for Japan, a domestic key 40*a* is arranged at the right end of the shutter 37 seen from the front side of the MFP 10. As shown in FIG. 3, for example, if a toner cartridge 26*b* is for Southeast Asia, a key 40*b* for Southeast Asia is arranged at the left end of the shutter 37 seen from the front side of the MFP 10. As shown in FIG. 4, for example, if a toner cartridge 26*c* is for North America, a key 40*c* for North America is arranged at the center of the shutter 37 seen from the front side of the MFP 10.

The type of the toner container is not limited to the type according to the destination of the cartridge. The type of the toner container may be the type according to the model of the MFP, the type according to the color of toner, or the like.

Figure 5:
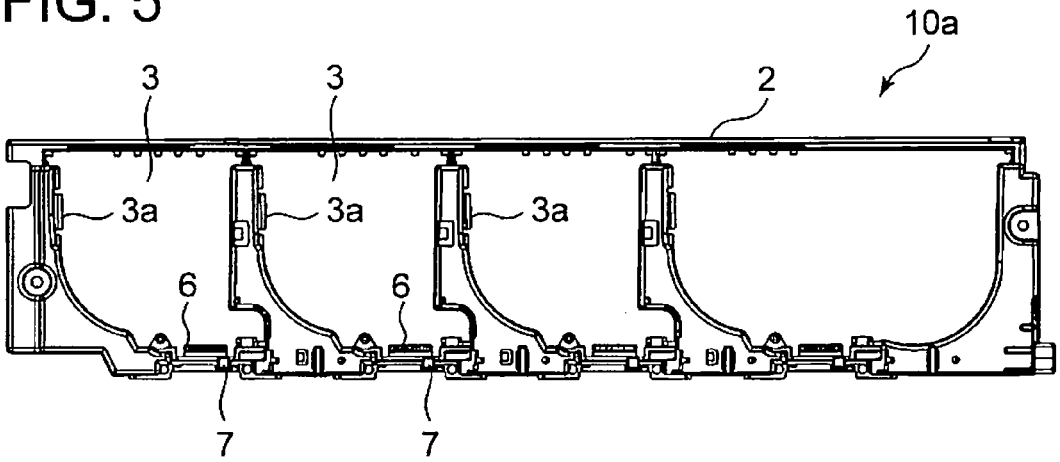
FIG. 5 is a schematic perspective view showing a toner cartridge holder for Japan in the first embodiment.
Figure 6:
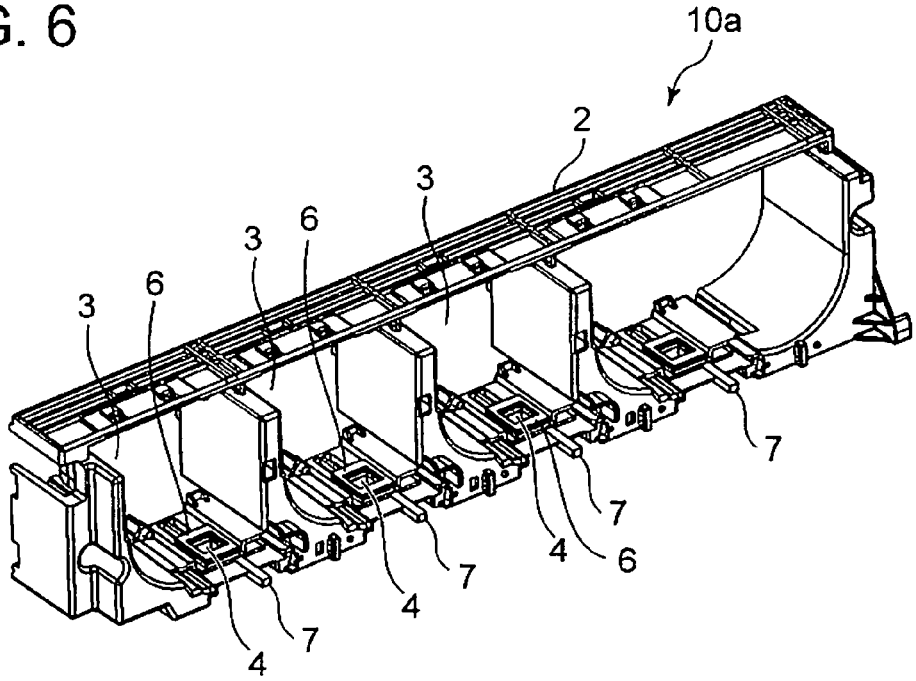
FIG. 6 is a schematic side view showing the toner cartridge holder for Japan in the first embodiment.

The cartridge holder 2 will be described in detail with reference to FIG. 5 and FIG. 6. The cartridge holder 2 includes a toner inflow port 4 on the bottom of a toner cartridge containing part 3 provided with a guide rail 3*a*. A support frame 6 of the toner inflow port 4 includes a pusher 7 as a release part at the front side. The arrangement position of the pusher 7 varies according to, for example, the destination of the MFP 10. For example, if the destination of the MFP 10*a* is Japan, as shown in FIG. 5 and FIG. 6, the pusher 7 is arranged at the right end of the support frame 6 seen from the front side of the MFP 10*a*. For example, if the destination of the MFP 10*b* is Southeast Asia, the pusher 7 is arranged at the left end of the support frame 6 seen from the front side of the MFP 10*b*. For example, if the destination of the MFP 10*c* is North America, the pusher 7 is arranged at the center of the support frame 6 seen from the front side of the MFP 10*c*.

If the destinations of the MFP 10 and the toner cartridge are the same and the combination of the MFP 10 and the toner cartridge 26 is correct, according to the toner cartridge 26 is mounted into the cartridge containing part 3 of the cartridge holder 2, the phases of the key 40 of the shutter 37 and the pusher 7 of the support frame 6 are coincident to each other, and the key 40 coincides with the pusher 7.

For example, in the MFP 10*a* whose destination is Japan, while printing is performed, toner is supplied to the developing devices 20Y, 20M, 20C and 20K, and if the toner cartridge 26*a* becomes empty, for example, the user replaces the toner cartridge 26*a*. The user pulls the empty toner cartridge 26*a* along the guide rail 3*a* in an arrow f direction shown in FIG. 7, and extracts the toner cartridge 26*a* from the cartridge containing part 3. According to the toner cartridge 26*a* slides in the arrow f direction, the domestic key 40*a* of the shutter 37 separates from the pusher 7 of the support frame 6, and the shutter 37 slides in an arrow g direction parallel to and opposite to the arrow f direction by the spring 37*b*. The shutter 37 slides in the arrow g direction and closes the toner supply port 36*a*.

Figure 7:
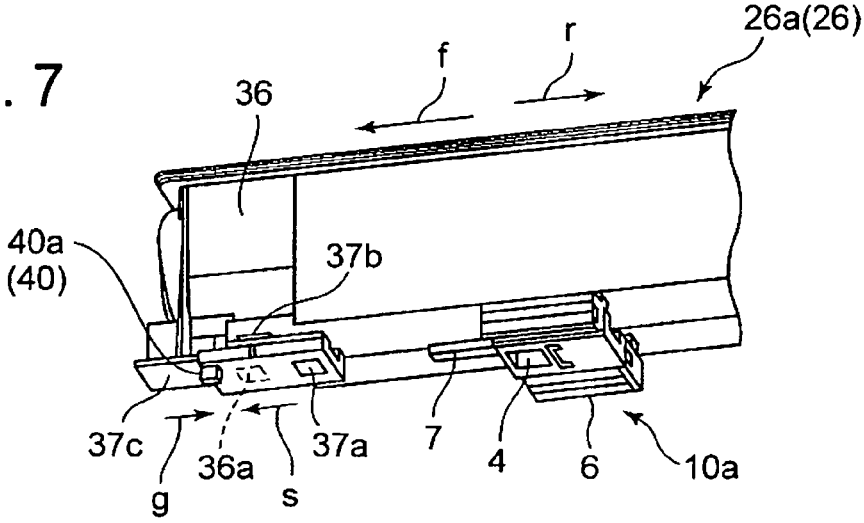
FIG. 7 is a schematic explanatory view showing sliding of a shutter according to a toner cartridge of the first embodiment is attached to and detached from a cartridge containing part.
Figure 10:
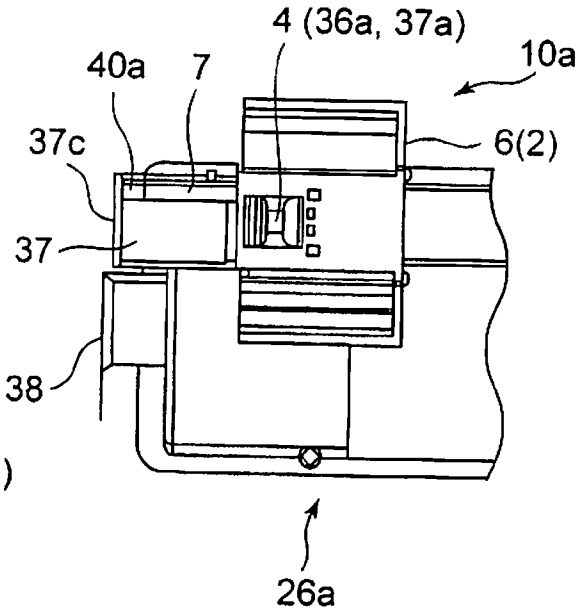
FIG. 10 is a partial plan view in which the shutter and the support frame are seen from below if the toner cartridge for Japan in the first embodiment is mounted in the cartridge containing part.
Figure 9:
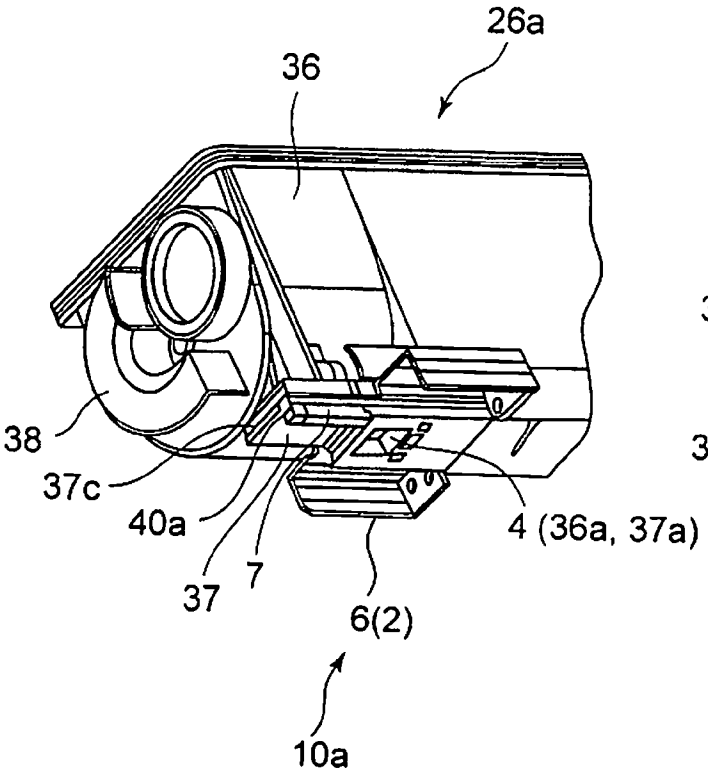
FIG. 9 is a partial perspective view in which the shutter and the support frame are seen from below if the toner cartridge for Japan in the first embodiment is mounted in the cartridge containing part.
Figure 8:
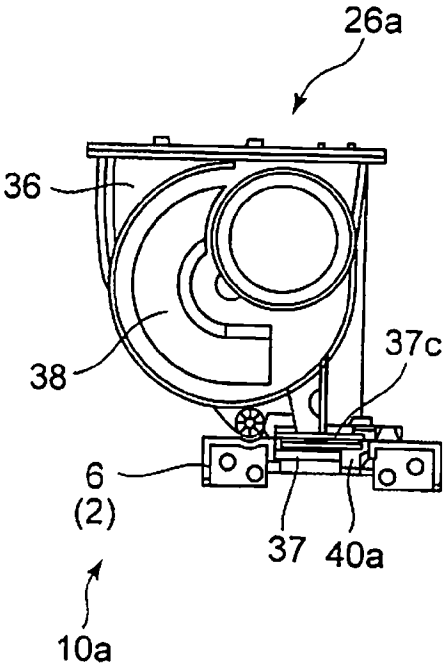
FIG. 8 is a schematic explanatory view showing a shutter and a support frame if the toner cartridge for Japan in the first embodiment is mounted in the cartridge containing part.

Next, the user slides a new toner cartridge 26*a* along the guide rail 3*a* of the cartridge containing part 3 in an arrow r direction of FIG. 7, and mounts the toner cartridge into the cartridge containing part 3. If the combination of the MFP 10*a* and the toner cartridge 26*a* is correct, the pusher 7 of the support frame 6 coincides with the domestic key 40*a* of the shutter 37. According to the toner cartridge 26*a* which can be correctly combined with the MFP 10*a* slides and is mounted in the arrow r direction, the pusher 7 of the support frame 6 contacts the domestic key 40*a* of the shutter 37. The shutter 37 is pushed by the pusher 7, and slides in an arrows direction parallel to and opposite to the arrow r direction. The shutter 37 slides in the arrows direction as the opening direction, and as shown in FIG. 8 to FIG. 10, the shutter opens the toner supply port 36*a* of the toner cartridge 26*a*, and the toner supply port 36*a* and the toner inflow port 4 communicate with each other through the communication port 37*a*.

The mounting of the toner cartridge 26*a* into the cartridge containing part 3 is completed at the position where the toner supply port 36*a* and the toner inflow port 4 communicate with each other. Thereafter, in accordance with the print operation, toner in the toner container 36 of the toner cartridge 26*a* is supplied to the developing device 20Y, 20M, 20C and 20K from the toner supply port 36*a* through the toner inflow port 4.

Figure 11:
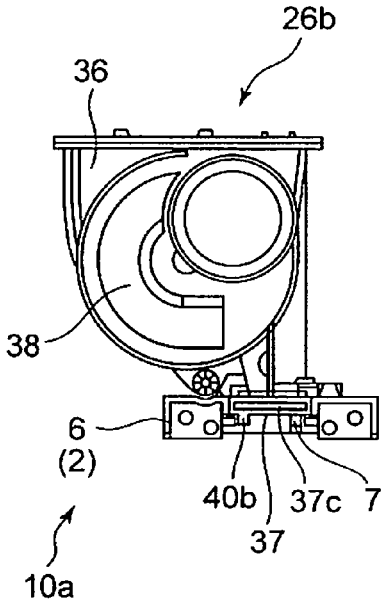
FIG. 11 is a schematic explanatory view showing the shutter and the support frame if the toner cartridge for Southeast Asia in the first embodiment is mounted in the cartridge containing part.
Figure 12:
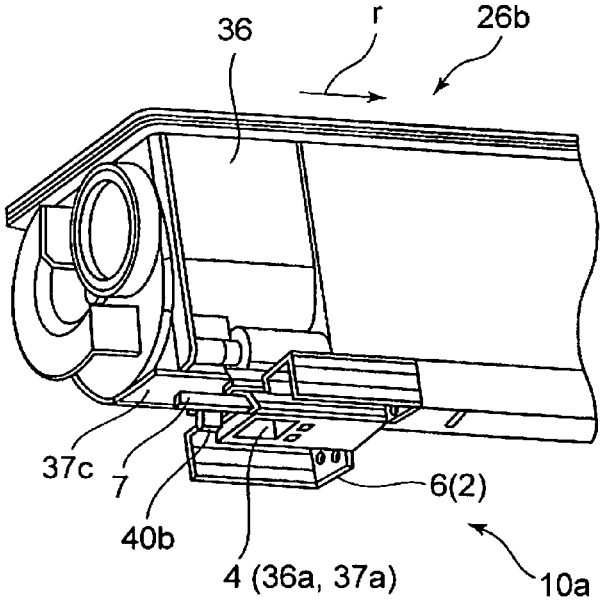
FIG. 12 is a partial perspective view in which the shutter and the support frame are seen from below if the toner cartridge for Southeast Asia in the first embodiment is mounted in the cartridge containing part.

It is assumed that the combination of the MFP 10 and the toner cartridge 26 mounted in the cartridge containing part 3 by the user after the empty toner cartridge 26*a* is extracted from the cartridge containing part 3 is erroneous. For example, as shown in FIG. 11 and FIG. 12, it is assumed that the user mounts the toner cartridge 26*b* for Southeast Asia in the MFP 10*a* whose destination is Japan. While the pusher 7 is arranged at the right end of the support frame 6 seen from the front side of the MFP 10*a*, the key 40*b* of the toner cartridge 26*b* for Southeast Asia, which is in error in combination, is arranged at the left end of the shutter 37 seen from the front side of the MFP 10. Accordingly, the pusher 7 of the support frame 6 and the key 40*b* for Southeast Asia of the shutter 37 of the toner cartridge 26*b* for Southeast Asia are not coincident with each other in phase.

If the toner cartridge 26*b* for Southeast Asia is slid in the arrow r direction from the front side of the MFP 10 for Japan and is mounted into the cartridge containing part 3, as shown in FIG. 11 and FIG. 12, the pusher 7 of the support frame 6 does not contact the key 40*b* for Southeast Asia of the shutter 37, and goes past the key 40*b* for Southeast Asia. Even if the toner cartridge 26*b* for Southeast Asia is mounted into the cartridge containing part 3, the shutter 37 is not slid by the mounting of the toner cartridge 26*b* for Southeast Asia. Since the toner supply port 36*a* of the toner cartridge 26*b* for Southeast Asia remains closed by the shutter 37, the toner cartridge 26*b* for Southeast Asia cannot supply toner in the toner container 36 to the developing devices 20Y, 20M, 20C and 20K.

Similarly, also if the user mounts the toner cartridge 26*c* for North America, which is in error in combination with the MFP 10*a* for Japan, the pusher 7 of the support frame 6 and the key 40*c* for North America of the shutter 37 of the toner cartridge 26*c* for North America are not coincident with each other in phase. Even if the toner cartridge 26*c* for North America is mounted into the cartridge containing part 3, the toner supply port 36*a* remains closed by the shutter 37, and the toner supply can not be performed.

The toner cartridge 26*b* for Southeast Asia is correctly combined with the MFP 10*b* whose destination is Southeast Asia, and the toner cartridge 26*c* for North America is correctly combined with the MFP 10*c* whose destination is North America. Accordingly, if the toner cartridge 26*b* for Southeast Asia or the toner cartridge 26*c* for North America is mounted into the MFP 10*b* for Southeast Asia or the MFP 10*c* for North America respectively, the respective key 40*b* or 40*c* coincides with the respective pusher 7 of the MFP 10*b* or 10*c* and slides the shutter in the open direction by the mounting operation, and the toner supply can be performed.

According to the first embodiment, the key 40 to indicate the destination of the toner cartridge 26 is arranged on the shutter 37 of the toner cartridge 26. If the combination of the toner cartridge 26 and the MFP 10 is correct, the key 40 and the pusher 7 coincide with each, and accordingly, the shutter 37 slides in the opening direction, and the toner is supplied from the toner cartridge 26. If the combination of the toner cartridge 26, and the MFP 10 is erroneous, and the key 40 does not coincide with the pusher 7, the shutter 37 is not opened, and the toner supply from the toner cartridge 26 is inhibited. The user is prevented from using the toner cartridge 26 which is in error in combination with the MFP. Besides, the key 40 is formed on the shutter 37 as a small part as compared with the toner container 36, and the manufacturing cost of the key 40 is reduced.

Second Embodiment

Next, a second embodiment will be described. In the second embodiment, the shape of a key provided on a shutter is changed according to the type of a toner container. In the second embodiment, the same components as those described in the first embodiments are denoted by the same reference numerals and their detailed description will be omitted.

Figure 13:
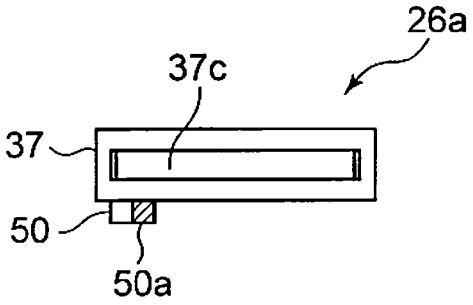
FIG. 13 is a schematic explanatory view showing a domestic key in a second embodiment.
Figure 14:
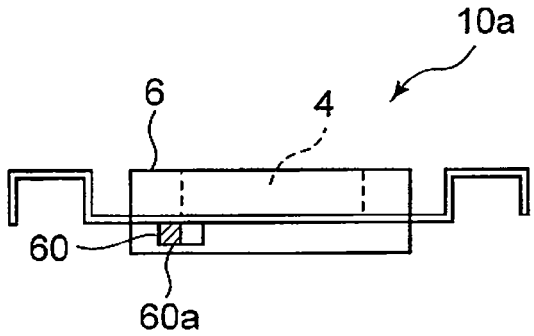
FIG. 14 is a schematic explanatory view showing a domestic pusher in the second embodiment.

For example, as shown in FIG. 13, in a toner cartridge 26*a* whose destination is Japan, a domestic key 50 whose section is rectangular is arranged at the left end of a shutter 37 seen from the front side of an MFP 10. Besides, as shown in FIG. 14, in an MFP 10*a* whose destination is Japan, a domestic pusher 60 whose section is rectangular and coincides with the domestic key 50 is arranged at the left end of a support frame 6 seen from the front side of the MFP 10*a*.

If the toner cartridge 26*a* whose destination is Japan is mounted into a cartridge containing part 3 of the MFP 10*a* whose destination is Japan, an oblique line area 60*a* of the domestic pusher 60 contacts an oblique line area 50*a* of the domestic key 50 during the mounting operation, and the shutter 37 is pressed by the pusher 60 and slides in an opening direction.

Figure 15:
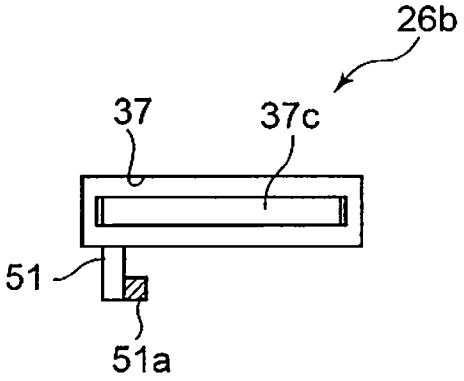
FIG. 15 is a schematic explanatory view showing a key for Southeast Asia in the second embodiment.
Figure 16:
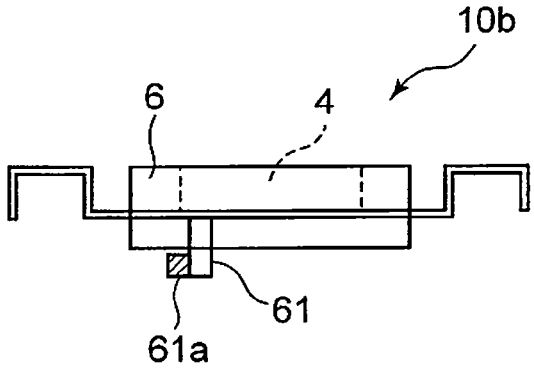
FIG. 16 is a schematic explanatory view showing a pusher for Southeast Asia in the second embodiment.

For example, as shown in FIG. 15, in a toner cartridge 26*b* whose destination is Southeast Asia, a key 51 for Southeast Asia, whose section is L-shaped, is arranged at the left end of a shutter 37 seen from the front side of an MFP 10. Besides, as shown in FIG. 16, in an MFP 10*b* whose destination is Southeast Asia, a pusher 61 for Southeast Asia, whose section is reverse-L-shaped and coincides with the key 51 for Southeast Asia, is arranged at the left end of a support frame 6 seen from the front side of the MFP 10*b*.

According to the toner cartridge 26*b* whose destination is Southeast Asia is mounted into the MFP 10*b* whose destination is Southeast Asia, an oblique line area 61*a* of the pusher 61 for Southeast Asia contacts an oblique line area 51*a* of the key 51 for Southeast Asia, and the shutter 37 is pressed by the pusher 61 for Southeast Asia and slides in an opening direction.

Figure 17:
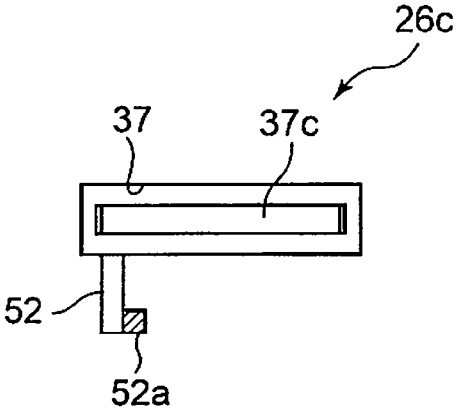
FIG. 17 is a schematic explanatory view showing a key for North America in the second embodiment.
Figure 18:
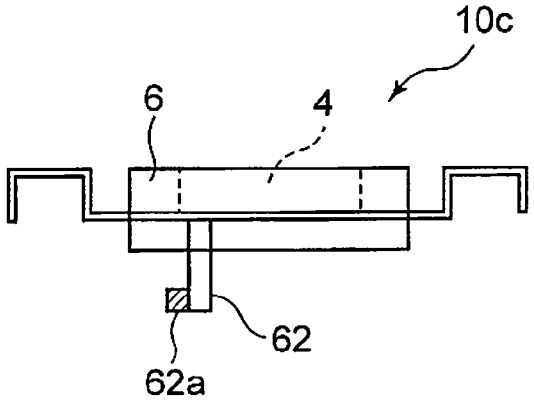
FIG. 18 is a schematic explanatory view showing a pusher for North America in the second embodiment.

For example, as shown in FIG. 17, in a toner cartridge 26*c* whose destination is North America, a key 52 for North America, whose section is L-shaped and is longer than the key 51 for Southeast Asia, is arranged at the left end of a shutter 37 seen from the front side of an MFP 10. Besides, as shown in FIG. 18, in an MFP 10*c* whose destination is North America, a pusher 66 for North America, whose section is reverse-L-shaped and coincides with the key 52 for North America, is arranged at the left end of a support frame 6 seen from the front side of the MFP 10*c*.

According to the toner cartridge 26*c* whose destination is North America is mounted into the MFP 10*c* whose destination is North America, an oblique line area 62*a* of the pusher 62 for North America contacts an oblique line area 52*a* of the key 52 for North America, and the shutter 37 is pressed by the pusher 62 for North America and slides in an opening direction.

For example, if the toner cartridge 26*b* for Southeast Asia, which is in error in combination, is mounted into the MFP 10*a* whose destination is Japan, the domestic pusher 60 does not coincide with the key 51 for Southeast Asia. The domestic pusher 60 goes past the key 51 for Southeast Asia, the toner supply port 36*a* of the toner cartridge 26*b* for Southeast Asia is not opened by the shutter 37, and toner supply can not be performed.

Similarly, also if the toner cartridge 26*c* for North America, which is in error in combination, is mounted into the MFP 10*a* whose destination is Japan, the domestic pusher 60 does not coincide with the key 52 for North America. The toner supply port 36*a* of the toner cartridge 26*c* for North America is not opened by the shutter 37, and toner supply can not be performed.

According to the second embodiment, similarly to the first embodiment, if the combination of the toner cartridge 26 and the MFP 10 is correct, the keys 50 to 52 coincide with the pushers 60 to 62, the shutter 37 slides in the opening direction, and the toner is supplied from the toner cartridge 26. If the combination with the MFP 10 is erroneous, the shutter 37 is not opened, and the toner supply by the toner cartridge 26 is inhibited. Besides, the keys 50 to 52 are formed on the shutter 37 as a small part as compared with the toner container 36, and the manufacturing cost of the keys 50 to 52 is reduced.

According to at least one of the above embodiments, the shutter of the toner cartridge is opened accordingly the key of the toner cartridge coincides with the release part of the image forming apparatus body.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A toner cartridge comprising:

a toner container configured to be inserted into and removed from an image forming apparatus body;

a shutter configured to open and close a toner supply port of the toner container, the shutter being configured to slide in a direction that is parallel to a direction along which the toner container is inserted into and removed from the image forming apparatus body; and a key that indicates a type of the toner cartridge, wherein if the key coincides with a corresponding release part of the image forming apparatus body, the key slides the shutter to open the toner supply port when the toner container is inserted into the image forming apparatus body, and if the key does not coincide with the corresponding release part of the image forming apparatus body, the key does not slide the shutter to open the toner supply port when the toner container is inserted into the image forming apparatus body.

2. The toner cartridge of claim 1, wherein the key is formed on the shutter, and is positioned to contact the release part of the image forming apparatus body.

3. The toner cartridge of claim 2, wherein a shape of the key varies according to the type of the toner cartridge.

4. The toner cartridge of claim 2, wherein a position of the key on the shutter varies according to the type of the toner cartridge.

5. The toner cartridge of claim 1, wherein the type of the toner cartridge varies according to a destination of the toner cartridge.

6. The toner cartridge of claim 1, wherein the type of the toner cartridge varies according to a model of the toner cartridge.

7. The toner cartridge of claim 1, wherein the type of the toner cartridge varies according to the type of toner contained in the toner container.

8. An image forming apparatus comprising:

a developing device configured to develop an electrostatic latent image formed on an image carrier;

a cartridge holder configured to receive and support a toner cartridge to supply toner to the developing device; and a release part provided on the cartridge holder indicating a type of toner cartridge usable in the image forming apparatus, wherein if the release part coincides with a key on the toner cartridge indicating a type of the toner cartridge, the release part slides a shutter on the toner cartridge in parallel to the insertion and removal direction to open a toner supply port, when the toner cartridge is inserted into the image forming apparatus body, and if the release part does not coincide with the key on the toner cartridge, the release part does not slide the shutter to open the toner supply port when the toner cartridge is inserted into the image forming apparatus body.

9. The image forming apparatus of claim 8, wherein the release part contacts the key when the toner cartridge is inserted into the image forming apparatus body.

10. The image forming apparatus of claim 9, wherein a shape of the release part varies according to the type of the toner cartridge usable in the image forming apparatus.

11. The image forming apparatus of claim 9, wherein an arrangement position of the release part varies according to the type of the toner cartridge that is usable in the image forming apparatus.

12. The image forming apparatus of claim 8, wherein the type of the toner cartridge usable in the image forming apparatus varies according to a destination of the image forming apparatus.

13. The image forming apparatus of claim 8, wherein the type of the toner cartridge usable in the image forming apparatus varies according to a model of the image forming apparatus.

14. The image forming apparatus of claim 8, wherein the type of the toner cartridge usable in the image forming apparatus varies according to the type of toner contained in the toner cartridge.

15. A method comprising:

inserting a toner cartridge into an image forming apparatus body in an insertion direction;

if a key on the toner cartridge coincides with a corresponding release part of the image forming apparatus body, sliding a shutter in a direction parallel to the insertion direction to open a toner supply port, and if the key does not coincide with the corresponding release part of the image forming apparatus body, receiving the toner cartridge in the image forming apparatus body without sliding the shutter and without opening the toner supply port.

* * * * *